US009975560B2

(12) United States Patent
Wieser et al.

(10) Patent No.: US 9,975,560 B2
(45) Date of Patent: May 22, 2018

(54) CABLE TRANSPORTATION SYSTEM WITH AT LEAST ONE HAUL CABLE AND A TROLLEY, AND RELATIVE OPERATING METHOD

(75) Inventors: Hartmut Wieser, Racines (IT); Nikolaus Erharter, San Candido (IT)

(73) Assignee: LEITNER S.P.A., Vpiteno (IT)

( * ) Notice: Subject to any disclaimer, the term of this patent is extended or adjusted under 35 U.S.C. 154(b) by 454 days.

(21) Appl. No.: 13/995,830

(22) PCT Filed: Dec. 22, 2011

(86) PCT No.: PCT/IB2011/055918

§ 371 (c)(1),
(2), (4) Date: Aug. 21, 2013

(87) PCT Pub. No.: WO2012/085883

PCT Pub. Date: Jun. 28, 2012

(65) Prior Publication Data

US 2013/0319280 A1 Dec. 5, 2013

(30) Foreign Application Priority Data

Dec. 22, 2010 (IT) ..... MI2010A2374

(51) Int. Cl.
*B61B 7/02* (2006.01)
*B61B 12/02* (2006.01)
*B61B 12/04* (2006.01)

(52) U.S. Cl.
CPC ..... *B61B 7/02* (2013.01); *B61B 12/02* (2013.01); *B61B 12/04* (2013.01)

(58) Field of Classification Search
CPC ..... B61B 7/02; B61B 12/02; B61B 12/022; B61B 12/04
(Continued)

(56) References Cited

U.S. PATENT DOCUMENTS 4,957,047 A * 9/1990 Feuz et al. ..... 104/204
6,345,578 B1 * 2/2002 Pabst ..... 104/112
(Continued)

FOREIGN PATENT DOCUMENTS

FR 2604138 3/1988
FR 2 670 452 6/1992
(Continued)

OTHER PUBLICATIONS

International Search Report and Written Opinion for International Application No. PCT/IB2011/055918 dated Jun. 5, 2012.
(Continued)

*Primary Examiner* — Zachary L Kuhfuss
(74) *Attorney, Agent, or Firm* — Neal, Gerber & Eisenberg LLP

(57) ABSTRACT

A cable transportation system having a rolling track extending along a designated path; a trolley configured to roll along the rolling track; a haul cable extending along the designated path and selectively connectable to the trolley; and at least one roller assembly having a frame, a plurality of rollers fitted movably to the frame, and elastic members located between the frame and the rollers to enable the rollers to assume a first operating position contacting the haul cable, and a second operating position lower than the first operating position and contacting the trolley as the trolley runs along the roller assembly.

22 Claims, 3 Drawing Sheets

(58) Field of Classification Search
USPC ..... 104/173.1, 173.2
See application file for complete search history.

(56) References Cited

U.S. PATENT DOCUMENTS

| | | | | |
|---|---|---|---|---|
| 6,543,366 | B2 * | 4/2003 | Pabst et al. | 104/202 |
| 7,549,377 | B2 * | 6/2009 | Pabst | 104/180 |
| 8,522,689 | B2 * | 9/2013 | Beck | 104/112 |
| 2002/0088368 | A1 * | 7/2002 | Pabst et al. | 104/87 |
| 2002/0134276 | A1 * | 9/2002 | Pabst et al. | 104/87 |
| 2012/0042803 | A1 * | 2/2012 | Beck | 104/112 |

FOREIGN PATENT DOCUMENTS

| | | |
|---|---|---|
| WO | WO 2005/032901 | 4/2005 |
| WO | WO 2009/130239 | 10/2009 |
| WO | WO 2010/076644 | 7/2010 |

OTHER PUBLICATIONS

Notification Concerning Submission, Obtention or Transmittal of Priority Document (Form PCT/IB/304) dated Mar. 20, 2012.
Response to International Search Report and the associated Written Opinion dated Oct. 18, 2012.
PCT Demand (Form PCT/IPEA/401).
Notification of Receipt of Demand by Competent International Preliminary Examining Authority (Form PCT/IPEA/402) dated Oct. 26, 2012.
Second Written Opinion of the International Preliminary Examining Authority dated Dec. 3, 2012.
Response to the Second Written Opinion dated Feb. 1, 2013.
Notification of Transmittal of the International Preliminary Report on Patentability (Form PCT/IPEA/416) dated Mar. 8, 2013.
International Preliminary Report on Patentability (Form PCT/IPEA/409) dated Mar. 8, 2013.
Chinese Office Action for Application No. 201180062597.7 dated Apr. 3, 2015.

* cited by examiner

CABLE TRANSPORTATION SYSTEM WITH AT LEAST ONE HAUL CABLE AND A TROLLEY, AND RELATIVE OPERATING METHOD

PRIORITY CLAIM

This application is a national stage application of PCT/IB2011/055918, filed on Dec. 22, 2011, which claims the benefit of and priority to Italian Patent Application No. MI2010A 002374, filed on Dec. 22, 2010, the entire contents of which are each incorporated by reference herein.

BACKGROUND

In certain known cable transportation systems, when a haul cable extends along a relatively long path, the haul cable must be supported by one or more roller assemblies along portions of the path. This applies to both cable transportation systems in which the trolley rolling track is defined by one or more supporting cables, and cable transportation systems, such as cable railways, in which the trolley rolling track is defined by rails. As the trolley runs along the roller assembly, the trolley lifts the haul cable off the rollers, which has a number of undesirable effects: increased load on the trolley; increase in stress exchanged between the trolley and the rolling track; and oscillation of the haul cable.

The first two can be prevented by oversizing the most severely stressed parts, but only at the expense of increasing the size and weight of the cable transportation system as a whole. Oscillation of the haul cable, on the other hand, may result in the haul cable even jumping the rolling track and obstructing the trolley. Systems for dampening the oscillations are disclosed in French Patent No. FR 2,670,452, PCT Patent Application No. WO 2009/130239 and PCT Patent Application No. WO 2005/032901. These systems proved to be effective in dampening the oscillations but they do not solve any one of the first two problems.

SUMMARY

The present disclosure relates to a cable transportation system with at least one haul cable and a trolley.

More specifically, the present disclosure relates to a cable transportation system comprising a rolling track extending along a designated or given path; a trolley configured to roll along the rolling tack; a haul cable extending along the designated or given path and connectable selectively to the trolley; and at least one roller assembly comprising a frame, and at least one roller fitted to the frame and configured to support the haul cable along a portion of the designated or given path.

It is one advantage of the present disclosure to provide a cable transportation system configured to eliminate certain of the drawbacks of certain of the known art.

According to the present disclosure, there is provided a cable transportation system with at least one haul cable and a trolley, the cable transportation system comprising a rolling track extending along a designated or given path; a trolley configured to roll along the rolling track; a haul cable extending along the designated or given path and selectively connectable to the trolley; and at least one roller assembly comprising a frame, at least one roller fitted movably to the frame and configured to support the haul cable along a designated or given portion of the path, and at least one elastic member located between the frame and the roller to enable the roller to assume a first operating position contacting the haul cable; wherein the at least one elastic member enables the roller to assume a second operating position lower than the first operating position and contacting the trolley as the trolley runs along the roller assembly; the cable transportation system being characterized in that the roller assembly comprises a plurality of aligned rollers fitted movably to the frame, and a plurality of elastic members; each roller being connected to the frame by at least one elastic member.

The haul cable is thus kept under control by the roller, which moves down as the trolley runs past, but without losing contact with the cable or trolley, and so supports part of the load of the cable and trolley. As the trolley runs past, there is therefore very little variation in the load on the roller assembly, and displacement of the haul cable is also minimized.

In one embodiment of the present disclosure, the roller rotates about a first axis crosswise to the designated or given path, and the roller is connected to the frame by the elastic member.

In one embodiment, the roller assembly comprises a shock absorber; the roller being connected to the frame utilizing the shock absorber.

Any oscillation of the roller caused by passage of the trolley is thus damped.

In one embodiment, the roller assembly comprises a movable arm hinged to the frame about a second axis crosswise to the designated or given path, the roller being fitted to a respective movable arm to rotate about the first axis; and a fixed arm integral with the frame and adjacent to a respective movable arm; the movable arm and the fixed arm being configured to define a seat for the elastic member and/or shock absorber.

In one embodiment of the present disclosure, the trolley comprises a clamp, which, in use, extends partly beneath the haul cable and is positioned directly contacting the roller.

Part of the load of the haul cable is thus supported at all times by the roller, even as the trolley runs past.

In addition, each roller is movable with respect to the frame independently of the other rollers.

Consequently, the load transmitted by the haul cable is distributed between the various rollers.

Another advantage of the present disclosure is to provide a method of operating a cable transportation system having at least one haul cable and a trolley, configured to eliminate certain of the drawbacks of certain of the known art.

According to the present disclosure, there is provided a method of operating a cable transportation system having at least one haul cable and a trolley, the method comprising the step of running a trolley along a rolling track, extending along a designated or given path, utilizing a haul cable, which extends along the designated or given path, is selectively connectable to the trolley, and is supported along a portion of the designated or given path defined by at least a roller assembly, which comprises a frame, at least one roller fitted movably to the frame, and at least one elastic member located between the frame and the roller; the method comprising the steps of lowering the roller from a first operating position wherein the roller is contact with the haul cable to a second operating position wherein the roller is in contact with the trolley as the trolley runs past and utilizing the trolley itself, and restoring the roller to the first operating position once the trolley has run past; the method being characterized in that the roller assembly comprises a plurality of aligned rollers fitted movably to the frame, and a plurality of elastic members; each roller being connected to the frame by at least one elastic member; and the method comprising the step of moving each of said plurality of rollers between a first and a second operating position as the trolley runs; the trolley being configured to maintain a quantity or number of rollers, fewer than said plurality of rollers, simultaneously in the second operating position.

In this way, the haul cable need not be moved from its normal position on the roller assembly.

In one embodiment, the method comprises cushioning movement of the roller between the first and second operating position.

In one embodiment, the trolley comprises a clamp configured to grip the haul cable; the roller comprises a groove configured to house the haul cable and the clamp; and the method comprises lowering the roller utilizing the clamp.

Movement of the roller is thus minimized.

In one embodiment of the present disclosure, the method comprises lowering and enabling gradual springback of the roller utilizing two wedge-shaped cams at opposite ends of the clamp respectively.

As a result, gradual transition is achieved between the first operating position, in which the roller supports the haul cable, and the second operating position, in which the roller partly supports the trolley, in turn connected to the haul cable.

Additional features and advantages are described in, and will be apparent from the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
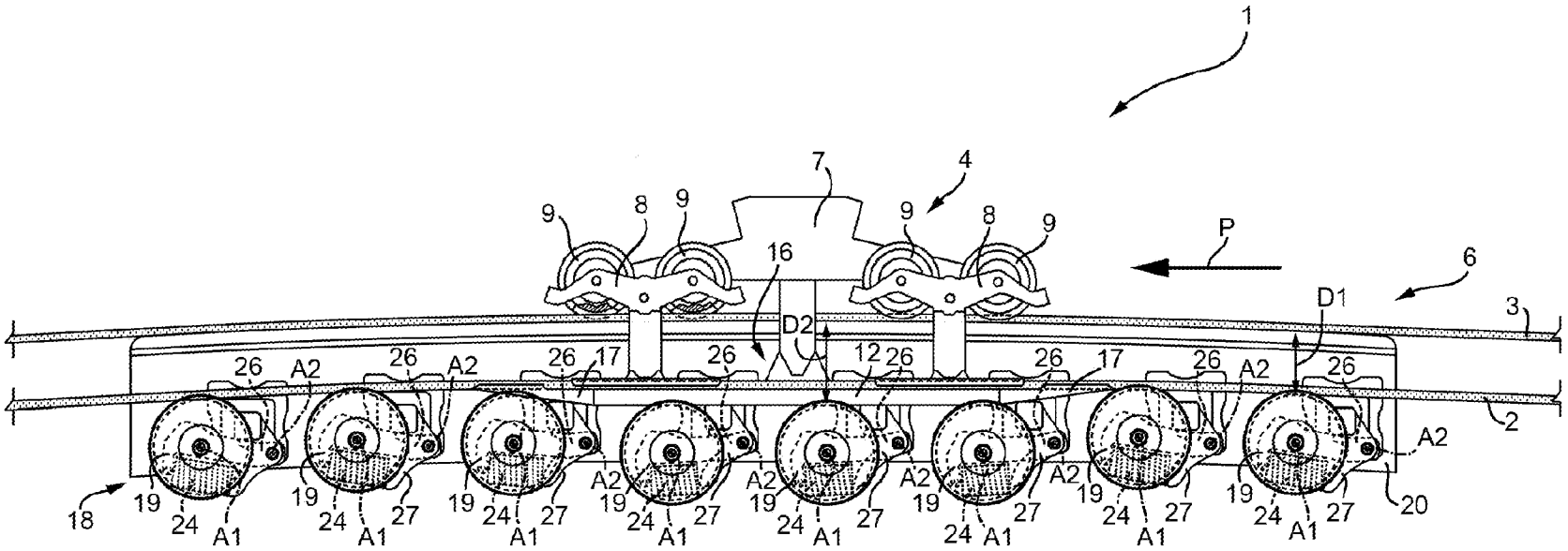
FIG. 1 shows a schematic, partly sectioned side view, with parts removed for clarity, of a cable transportation system in accordance with the present disclosure.

Referring now to the example embodiments of the present disclosure illustrated in FIGS. 1 to 4, number 1 in FIG. 1 indicates as a whole a cable transportation system comprising a haul cable 2; two supporting cables 3 (FIG. 2); a trolley 4 configured to run along supporting cables 3; and a roller assembly 5 configured to support supporting cables 3 and haul cable 2. Supporting cables 3 define a rolling track 6, along which trolley 4 runs, and which extends along a designated or given path P between two arrival/departure stations (not shown in the drawings).

Though the example shown refers specifically to a three-cable system, in which the rolling track is defined by two supporting cables, the present disclosure also applies to two-cable systems, in which the rolling track is defined by one supporting cable, and to cable railways, in which the rolling track is defined by rails.

Figure 2:
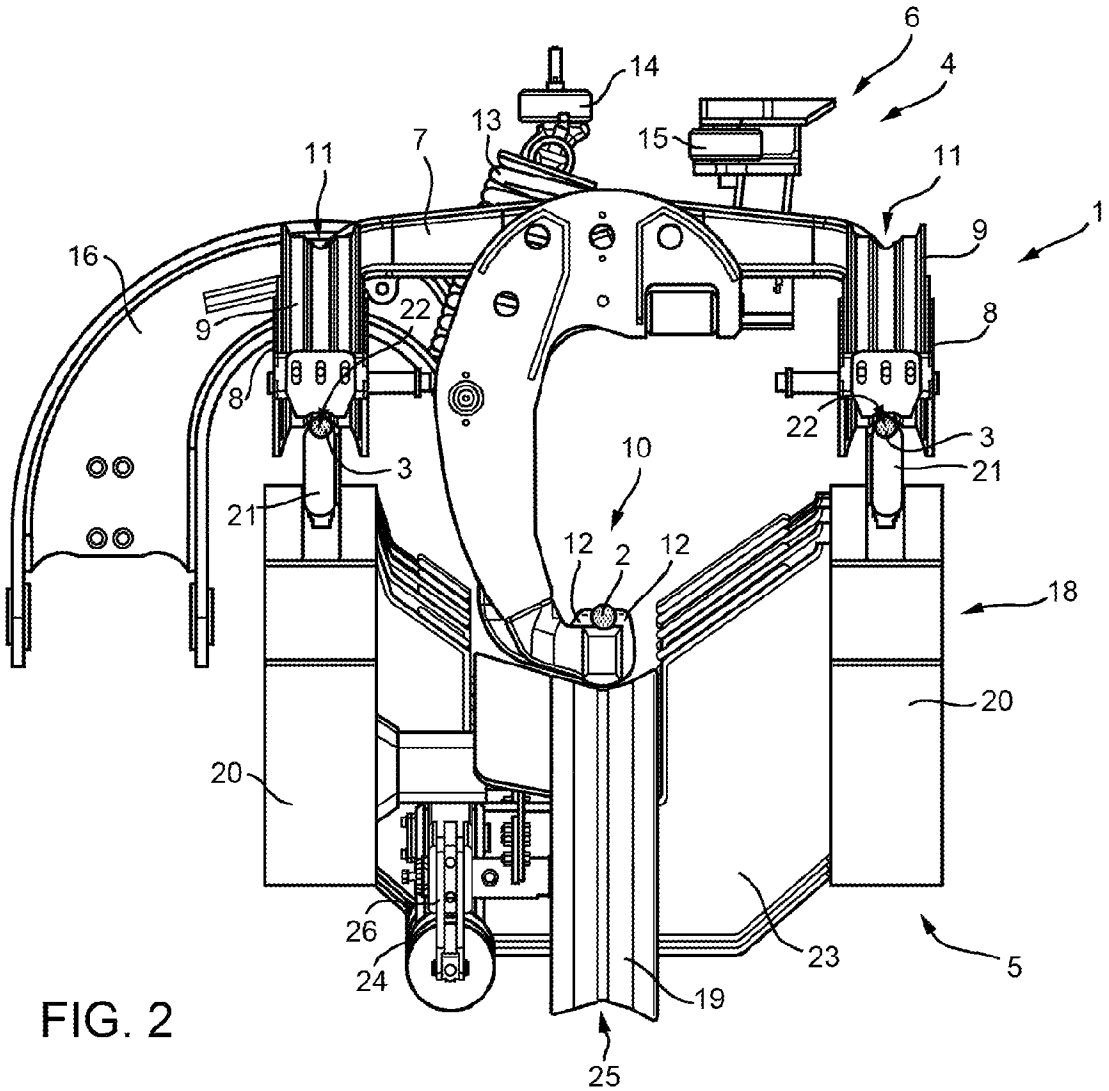
FIG. 2 shows a larger-scale, partly sectioned front view, with parts removed for clarity, of the FIG. 1 cable transportation system.

Trolley 4 comprises a frame 7; four rocker arms 8 (only two shown in FIG. 1), each hinged to frame 7 and supporting two wheels 9; and a camp 10 configured to selectively grip haul cable 2. As shown in FIG. 2, each wheel 9 comprises a groove 11 configured to partly house supporting cable 3. Clamp 10 comprises two jaws 12, which are configured to grip haul cable 2, are held in the grip position by a spring 13, and are selectively released by rollers 14 and 15 configured to engage cams (not shown) at the arrival/departure stations (not shown). Frame 7 comprises an arm 16 configured to support a transportation unit (not shown in the drawings). In other words, cable transportation system 1 is a so-called automatic drive-by clamp system.

As shown in FIG. 2, clamp 10 extends along an elongated portion, parallel to path P, and comprises two wedge-shaped end cams 17.

As shown in FIGS. 1 and 2, roller assembly 5 may be fixed to a pylon (not shown) or other fixed structure of the cable transportation system, and is configured to support haul cable 2 and, in the example shown, the two supporting cables 3 along a portion of path P. As shown in FIG. 2, roller assembly 5 comprises a frame 18, and a plurality of rollers 19 fitted movably to frame 18, which comprises two beams 20 parallel to each other and to path P and configured to support supporting cables 3. In the example shown, each beam 20 comprises a bar 21, in which a seat 22 is formed to house one of supporting cables 3; beams 20 are connected to each other by plates 23; and rollers 19 are located between the two beams 20, under supporting cables 3 (i.e., under rolling track 6), to support haul cable 2, which is located halfway between the two supporting cables 3, under rolling track 6.

As shown in FIG. 1, rollers 19 are located under haul cable 2 and supported by elastic members 24. In the embodiment shown, each roller 19 is movable, independently with respect to frame 18 and the other rollers 19, between a first operating position contacting haul cable 2, and a second operating position lower than the first and contacting clamp 10. In FIG. 1, four rollers 19 at apposite ends of roller assembly 5 are in the first operating position; three centre rollers 19 under clamp 10 are in the second operating position; and two rollers 19 at the cams are in an intermediate position between the first and second operating positions.

Figure 4:
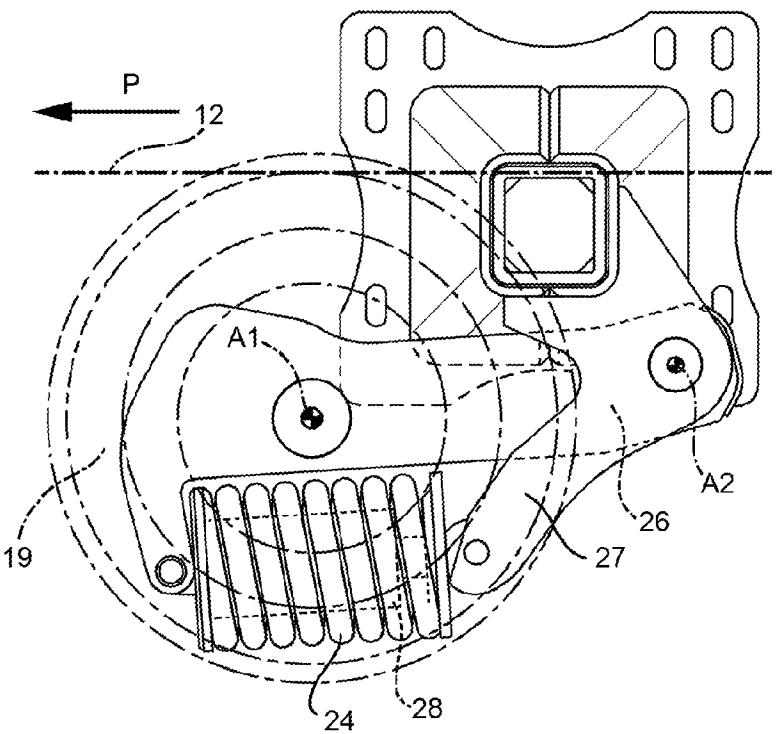
FIGS. 3 and 4 show larger-scale side views, with parts removed for clarity, of a detail of the FIG. 1 system in respective operating positions.
Figure 3:
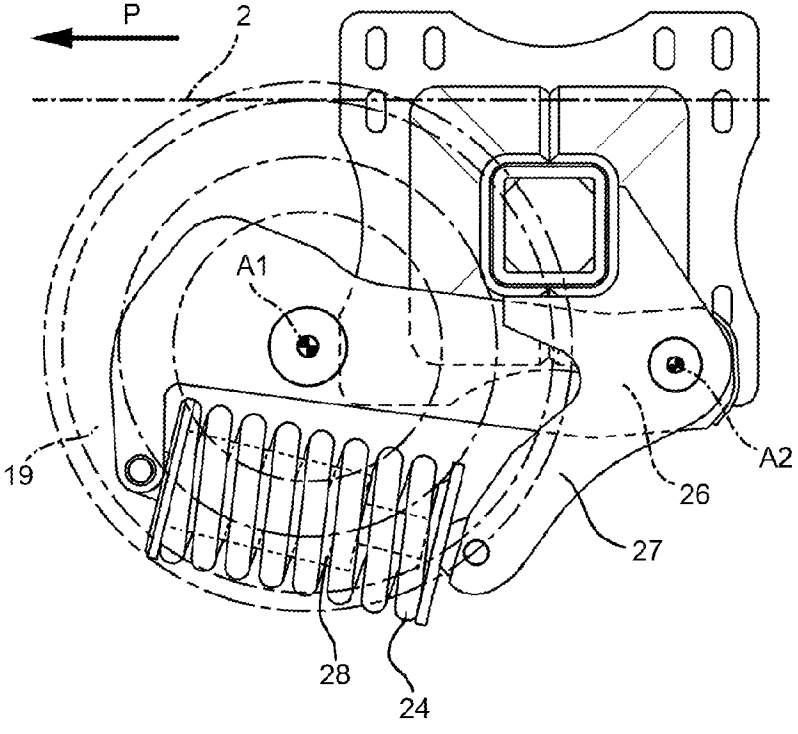

As shown in FIGS. 3 and 4, each roller 19 rotates about an axis A1 crosswise to designated or given path P, has a groove 25 (seen in FIG. 2) configured to house haul cable 2 and clamp 10, and is associated with a respective elastic member upwardly supporting roller 19. In one embodiment, as shown in FIG. 1, cable transportation system 1 comprises a plurality of movable arms 26, and a plurality of fixed arms 27.

As shown in FIGS. 3 and 4, each movable arm 26 supports a roller 19, and is hinged to frame 18 about an axis A2 parallel to axis A1. Each fixed arm 27 is located close to a movable arm 26; and movable arm 26 and fixed arm 27 are configured to define, between their free ends, a seat for an elastic member 24, which, in the example shown, works by compression and is, in one embodiment, a coil spring. Roller assembly 5 also comprises, for each roller 19, a shock absorber 28, which extends, parallel to elastic member 24, between the free ends of movable arm 26 and fixed arm 27.

FIG. 3 shows elastic member 24 extended, and roller 19 in the first operating position contacting haul cable 2; and FIG. 4 shows elastic member 24 compressed, and roller 19 in the lower second operating position contacting clamp 10.

As shown in FIG. 1, rollers 19 and rolling track 6 are separated by a vertical distance D1; and clamp 10 is configured so that, as trolley 4 runs along roller assembly 5, rollers 19 are positioned contacting clamp 10, and drop with respect to rolling track 6. That is, when positioned contacting clamp 10, each roller 19 is at a distance D2, greater than D1, from the rolling track, so, as trolley 4 runs along roller assembly 5, rollers 19 are lowered from the first to the second operating position, and haul cable 2 is only moved slightly and never extracted from grooves 25 (FIG. 2) in rollers 19, thus minimizing oscillation of the haul cable. Moreover, the shock absorbers prevent oscillation of rollers 19 as they spring back into position; and rollers 19 are never completely unloaded. That is, the loads on roller assembly 5 are distributed over the various component parts of roller assembly 5, even as trolley 4 runs past.

The present disclosure also covers embodiments not described in detail herein, as well as equivalent embodiments within the protective scope of the accompanying Claims. For example, the elastic members may be defined by leaf springs or other elastic members, and the rollers may be connected to the frame in various other ways. Accordingly, changes may be made to the present disclosure without, however, departing from the scope of the present disclosure as defined in the accompanying Claims. It should thus be understood that various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A cable transportation system comprising:
- a rolling track extending along a designated path;
- a trolley configured to roll along the rolling track;
- a haul cable extending along the designated path and selectively connectable to the trolley; and
- a roller assembly including:
  - a frame,
  - a plurality of elastic members, and
  - a plurality of aligned, upwardly biased rollers movably fitted to the frame, wherein each roller is connected to the frame by at least one of the elastic members to enable each of said rollers to independently move to:
    - a first operating position contacting the haul cable, and
    - a second operating position lower than the first operating position and contacting the trolley as the trolley runs along said roller assembly, wherein in the second operating position, said roller is configured to at least partially support the trolley as the trolley runs along said roller assembly.

2. The cable transportation system of claim 1, wherein at least one of the rollers rotates about a first axis crosswise to the designated path.

3. The cable transportation system of claim 2, wherein the roller assembly includes at least one movable arm hinged to the frame about a second axis crosswise to the designated path, at least one of the rollers being fitted to said movable arm to rotate about the first axis.

4. The cable transportation system of claim 3, wherein the roller assembly includes at least one fixed arm coupled to the frame and adjacent to said movable arm, the movable arm and the fixed arm configured to define a seat for at least one of: at least one of the elastic members and a shock absorber.

5. The cable transportation system of claim 1, wherein the roller assembly includes a plurality of shock absorbers and each of the rollers is connected to the frame utilizing at least one of the shock absorbers.

6. The cable transportation system of claim 1, wherein the plurality of rollers are each located beneath the haul cable.

7. The cable transportation system of claim 1, wherein a distance between at least one of the rollers and the rolling track varies as a function of a load on the at least one roller.

8. The cable transportation system of claim 1, which includes a supporting cable, wherein the frame of the roller assembly has a seat configured to: (i) partly house the supporting cable, and (ii) define part of the rolling track along the roller assembly.

9. The cable transportation system of claim 1, wherein the trolley includes a clamp configured to grip the haul cable and at least one of the rollers includes a groove configured to house the haul cable and the clamp.

10. The cable transportation system of claim 9, wherein, in use, the clamp extends partly beneath the haul cable and is positioned directly contacting said roller.

11. The cable transportation system of claim 10, wherein the clamp includes two wedge-shaped end cams, said cams configured to: (i) lower each of said rollers to the second operating position, and (ii) enable each of said rollers to a gradual springback to the first operating position.

12. The cable transportation system of claim 1, wherein the haul cable is located beneath the rolling track.

13. The cable transportation system of claim 1, wherein in the first operating position, the roller is configured to at least partially support the haul cable.

14. A cable transportation system roller assembly comprising:
- a frame;
- a plurality of elastic members; and
- a plurality of aligned, upwardly biased rollers movably fitted to the frame, wherein each roller is connected to the frame by at least one of the elastic members to enable each of said rollers to independently move to:
  - a first operating position in which said roller is configured to contact a haul cable, and
  - a second operating position in which said roller is configured to contact a trolley, said second operating position being lower than the first operating position, wherein in the second operating position, said roller is configured to at least partially support the trolley.

15. The cable transportation system roller assembly of claim 14, which includes a plurality of shock absorbers, wherein each of the rollers is connected to the frame utilizing at least one of the shock absorbers.

16. The cable transportation system roller assembly of claim 14, which includes at least one fixed arm coupled to the frame and adjacent to at least one movable arm, the movable arm and the fixed arm configured to define a seat for at least one of: at least one of the elastic members and a shock absorber.

17. The cable transportation system roller assembly of claim 14, wherein in the first operating position, the roller is configured to at least partially support the haul cable.

18. A method of operating a cable transportation system, the method comprising:
- utilizing a haul cable to run a trolley along a rolling track extending along a designated path, said haul cable: (i) extending along the designated path, (ii) being selectively connectable to the trolley, and (iii) being supported along a portion of the designated path defined by a roller assembly including a frame, a plurality of aligned, upwardly biased rollers movably fitted to the frame, and a plurality of elastic members, each roller being connected to the frame by at least one of the elastic members;
- as the trolley runs along the roller assembly, independently lowering each of the rollers from a first operating position wherein said roller is in contact with the haul cable to a second operating position wherein said roller is in contact with the trolley, wherein the trolley is configured to simultaneously maintain a quantity of the rollers in the second operating position, said quantity of the rollers being less than said plurality of rollers, and wherein in the second operating position, said roller at least partially supports the trolley; and after the trolley runs past the roller assembly, restoring each of the rollers to the first operating position.

19. The method of claim 18, which includes cushioning any movement of each of the rollers between the first operating position and the second operating position.

20. The method of claim 18, wherein the trolley includes a clamp configured to grip the haul cable, and each of the rollers includes a groove configured to house the haul cable and the clamp, and which includes utilizing the clamp to lower each of the rollers to the second operating position.

21. The method of claim 20, which includes utilizing two wedge-shaped cams at opposite ends of the clamp to respectively lower each of the rollers to the second operating position and enable each of the rollers to gradually spring-back to the first operating position.

22. The method of claim 18, which includes, in the first operating position, the roller at least partially supporting the haul cable.

* * * * *